US012252360B2

(12) United States Patent
Carboni et al.

(10) Patent No.: US 12,252,360 B2
(45) Date of Patent: Mar. 18, 2025

(54) BLANK FEEDING UNIT FOR A PACKER MACHINE AND PROVIDED WITH A POSITION REFERENCE ELEMENT

(71) Applicant: G.D SOCIETA' PER AZIONI, Bologna (IT)

(72) Inventors: Salvatore Carboni, Bologna (IT); Antonio Vitali, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 131 days.

(21) Appl. No.: 17/921,020

(22) PCT Filed: Jul. 8, 2021

(86) PCT No.: PCT/IB2021/056132
§ 371 (c)(1),
(2) Date: Oct. 24, 2022

(87) PCT Pub. No.: WO2022/009138
PCT Pub. Date: Jan. 13, 2022

(65) Prior Publication Data

US 2023/0339708 A1 Oct. 26, 2023

(30) Foreign Application Priority Data

Jul. 9, 2020 (IT) ..... 102020000016717

(51) Int. Cl.
*B65H 1/02* (2006.01)

(52) U.S. Cl.
CPC ..... *B65H 1/025* (2013.01); *B65H 2404/71* (2013.01); *B65H 2405/212* (2013.01); *B65H 2701/1764* (2013.01)

(58) Field of Classification Search
CPC ..... B65H 1/025; B65H 2404/71; B65H 2405/212; B65H 2701/1764;
(Continued)

(56) References Cited

U.S. PATENT DOCUMENTS 3,352,216 A * 11/1967 Wainberg ..... B65H 3/38 493/122
3,819,057 A * 6/1974 Cato ..... B65H 1/025 53/578

(Continued)

FOREIGN PATENT DOCUMENTS

EP 0816268 A2 1/1998
WO WO-90/06275 A1 6/1990

OTHER PUBLICATIONS

International Search Report and Written Opinion for Corresponding International Application No. PCT/IB2021/056132 mailing date Nov. 5, 2021.

(Continued)

*Primary Examiner* — Dariush Seif
(74) *Attorney, Agent, or Firm* — MARSHALL, GERSTEIN & BORUN LLP

(57) ABSTRACT

A feeding unit to feed blanks in a packer machine having: a frame; a hopper for holding a stack of blanks, supported by the frame, and having a pick-up opening, through which one blank at a time can be retrieved from the stack; and a conveyor, supported by the frame, which moves the blanks along a moving path ending in the hopper. The feeding unit can be adjusted by a format change operation to accommodate blacks of different formats by changing the feeding unit from a first configuration for containing a first format of blanks, to a second configuration for containing a second format of blanks, different from the first format. The hopper has a reference element, which, in use, is placed in contact with the stack of blanks to establish reference positions for the blanks relative to the frame that do not move due to a format change operation.

26 Claims, 11 Drawing Sheets

(58) Field of Classification Search
CPC ..... B65H 2701/176; B65H 2701/1766; B65H 2301/42242; B65H 2301/422; B65H 3/0816; B31B 50/00; B31B 50/06; B31B 50/022; B31B 2100/00
USPC ..... 193/309
See application file for complete search history.

(56) References Cited

U.S. PATENT DOCUMENTS 5,312,222 A * 5/1994 Neri ..... B65H 31/34 414/907
5,411,362 A * 5/1995 Neri ..... B65G 47/905 414/801
5,709,524 A * 1/1998 Tacchi ..... B65H 3/325 414/796
5,803,267 A * 9/1998 Tu ..... B65D 5/5021 206/723
5,860,269 A * 1/1999 Takahashi ..... B65H 1/025 53/64
6,189,827 B1 * 2/2001 Vollenweider ..... B65H 1/30 271/216
7,594,646 B2 9/2009 Flagg et al.
8,777,551 B1 * 7/2014 Widder ..... B65H 3/322 414/796.6
11,905,057 B2 * 2/2024 Jovanovic ..... B65B 59/001
2004/0022619 A1 * 2/2004 Spatafora ..... B65H 3/322 414/796
2007/0001363 A1 * 1/2007 Flagg ..... B65B 43/185 271/3.01
2008/0119341 A1 * 5/2008 Monti ..... B65H 1/30 493/182
2012/0094818 A1 * 4/2012 Monti ..... B65B 43/325 493/313
2013/0108408 A1 * 5/2013 Saison ..... B65H 3/0816 414/797
2014/0371045 A1 * 12/2014 Bruneau ..... B31B 50/74 493/52
2015/0021226 A1 * 1/2015 Jacomelli ..... B65D 5/4266 206/508
2021/0138756 A1 * 5/2021 Langen ..... B31B 50/262
2023/0339708 A1 * 10/2023 Carboni ..... B65H 1/025

OTHER PUBLICATIONS

International Search Report and Written Opinion for Corresponding International Application No. PCT/IB2021/056135 mailing date Feb. 23, 2022.

* cited by examiner

BLANK FEEDING UNIT FOR A PACKER MACHINE AND PROVIDED WITH A POSITION REFERENCE ELEMENT

CROSS-REFERENCE TO RELATED APPLICATIONS

This patent application is a U.S. national phase of International Patent Application No. PCT/IB2021/056132 filed Jul. 8, 2021, which claims the benefit of priority from Italian patent application no. 102020000016717 filed on Jul. 9, 2020, the respective disclosures of which are each incorporated herein by reference in there entireties.

TECHNICAL FIELD

The invention relates to a blank feeding unit for a packer machine.

PRIOR ART

A packer machine generally folds blanks around products to be packed or folds blanks in order to obtain empty packs designed to subsequently house, on the inside, products to be packed. As a consequence, a packer machine generally comprises a blank feeding unit, which houses a stack of blanks in a hopper and allows single blanks to be retrieved, one after the other, from a bottom of the stack (arranged in the area of a pick-up opening of the hopper) in order to direct the single blanks towards the folding line.

In the area of the pick-up opening, the hopper has holding elements, which fulfil the function of providing support for the blanks arranged inside the hopper, so as to prevent the blanks from getting out in an uncontrolled manner. In order to extract a blank from the pick-up opening of the hopper, (at least) a sucking holding head engages the blank and pulls the blank with a movement that allows the edges of the blank to slip out of the holding elements; during the retrieving operations, the blank generally slightly deforms so as to facilitate the extraction of the edges thereof from the holding elements.

Modern packer machines are more and more often subjected to a format change, namely to a series of technical interventions aimed at adjusting the production of the packs to a different format (size); in other words, in order to shift from the production of packs with a given size (format) to the production of packs with a different size (format), operators have to act upon different parts of the packer machine in order to adapt them to the new size (format). In order to change the size (format) of the packs, it obviously is necessary to use blanks with a different size (format) and, hence, the hopper of the feeding unit needs to be adjusted so as to contain and dispense blanks having a different size (format). The format change operations undergone by a blank hopper are particularly time-consuming and complicated, as the precise adjustment of the position of the holding elements arranged in the area of the pick-up opening requires numerous attempts; indeed, the position of the holding elements must be the result of a complicated compromise between the need to properly hold the stack of blanks inside the hopper (hence, avoiding that, while removing a blank, one or more adjacent blanks are accidentally removed as well) and the need not to damage (dent or scratch) the edges of the blank while retrieving it. Namely, the holding elements must sufficiently project into the pick-up opening in order to properly hold the stack of banks inside the hopper, but they cannot project too much into the pick-up opening so as not to damage the edges of the blank during the retrieving operations.

DESCRIPTION OF THE INVENTION

The object of the invention is to provide a blank feeding unit for a packer machine, said feeding unit allowing a format change to be carried out in a very quick manner, ensuring at the same time an ideal holding of the blanks (namely, ensuring that the edges of the blanks are not damaged in any way during the retrieving operations).

According to the invention, there is provided a blank feeding unit for a packer machine according to the appended claims.

The appended claims describe embodiments of the invention and form an integral part of the description.

BRIEF DESCRIPTION OF THE DRAWINGS

The invention will now be described with reference to the accompanying drawings, showing a non-limiting embodiment thereof, wherein.

PREFERRED EMBODIMENTS OF THE INVENTION

Figure 1:
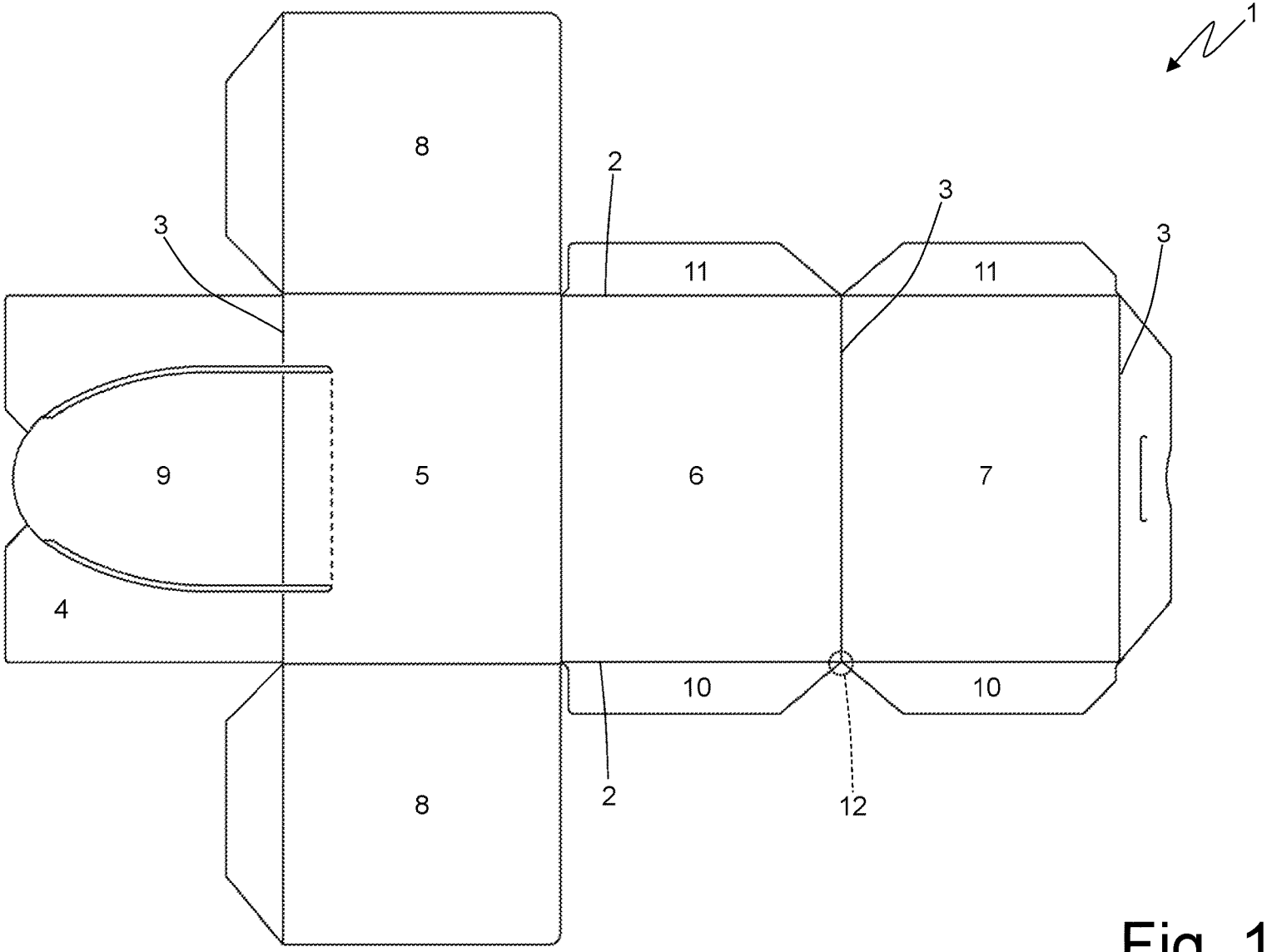
FIG. 1 is a plan view of a blank used to manufacture a pack designed to contain a group of coffee capsules.

In FIG. 1, number 1 indicates, as a whole, a blank used to manufacture a pack designed to contain a group of coffee capsules.

The blank 1 comprises two (pre-weakened) longitudinal folding lines 2 and a plurality of (pre-weakened) transverse folding lines 3, which define, between the two longitudinal folding lines 2, a panel 4 making up an upper wall of the pack, a panel 5 making up a rear wall of the pack, a panel 6 making up a lower wall of the pack and a panel 7 making up a front wall of the pack. On the opposite sides of the panel 5 there are two panels 8, which make up side walls of the pack and are connected to the panel 5 by the two longitudinal folding lines 2. The panels 4 and 5 have a coffee capsule extraction opening, which is normally closed by a hinged lid 9.

The blank 1 comprises two wings 10, which are connected to a longitudinal folding line 2, and two wings 11, which are connected to the other longitudinal folding line 2 on the opposite side relative the wings 10; in particular, two wings 10 and 11 are arranged at opposite ends of the panel 6 and are connected to the panel 6 by the two longitudinal folding lines 2, whereas the other two wings 10 and 11 are arranged at opposite ends of the panel 7 and are connected to the panel 7 by the two longitudinal folding lines 2. The wings 10 delimit, between one another, an empty space with a triangular shape, which has a vertex 12 in the area of a longitudinal folding line 2.

Figure 2:
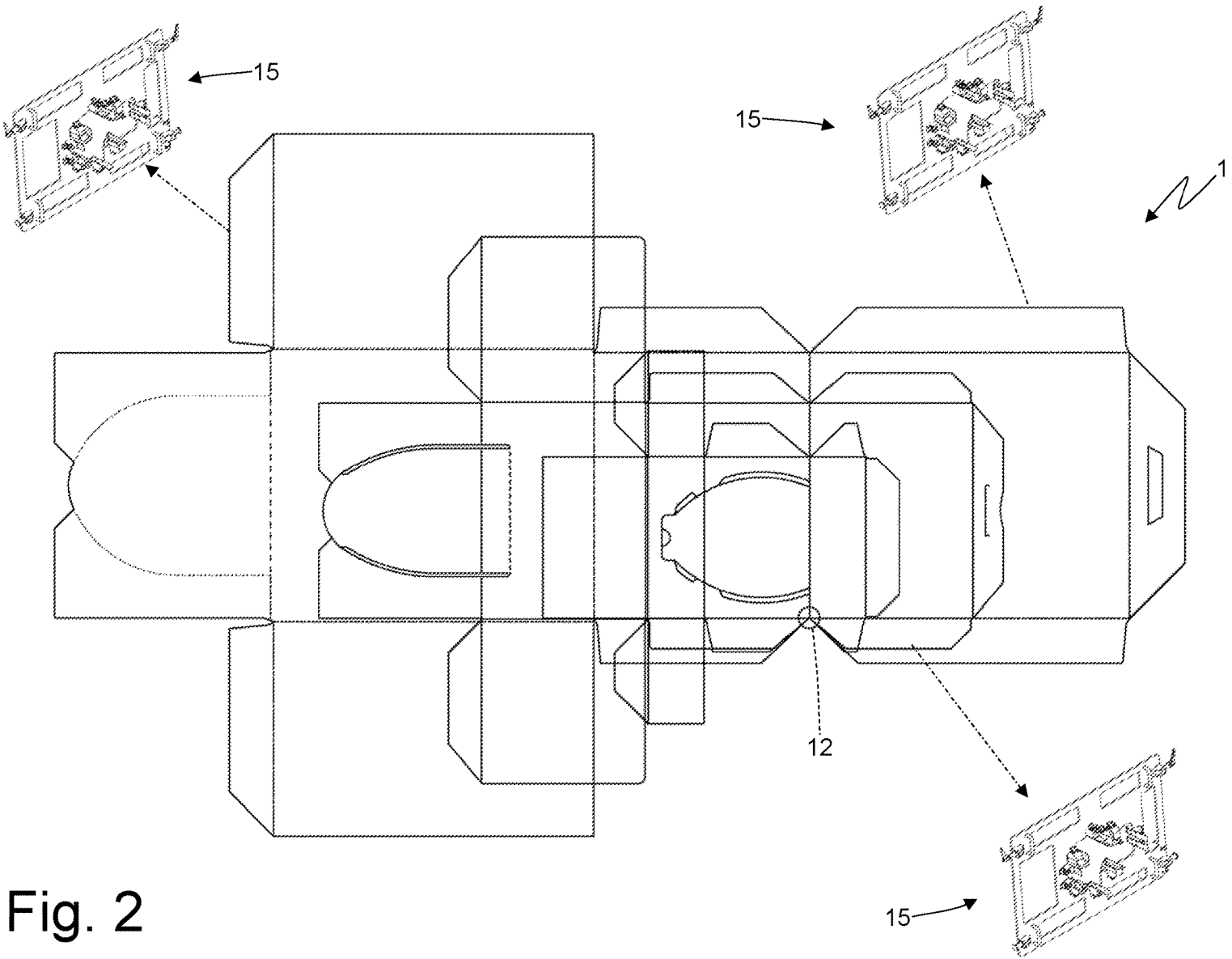
FIG. 2 is a plan view of three different blanks overlapping one another.

According to FIG. 2, there are blanks 1 (all having the same conformation, namely the same arrangement of panels and wings) with different formats (namely, different sizes), so as to manufacture corresponding packs having smaller or larger dimensions (namely, aimed at containing a different number of capsules and/or capsules with a different size). All blanks 1 with a different format (different size) can overlap one another using the corresponding vertexes 12 as position reference, namely always keeping the corresponding vertexes 12 in the same position (as shown in FIG. 2). In other words, all blanks 1 with a different format (different size) can overlap one another aligning the corresponding vertexes 12 with one another, so that the vertexes 12 are in the same position (as shown in FIG. 2).

Figure 3:
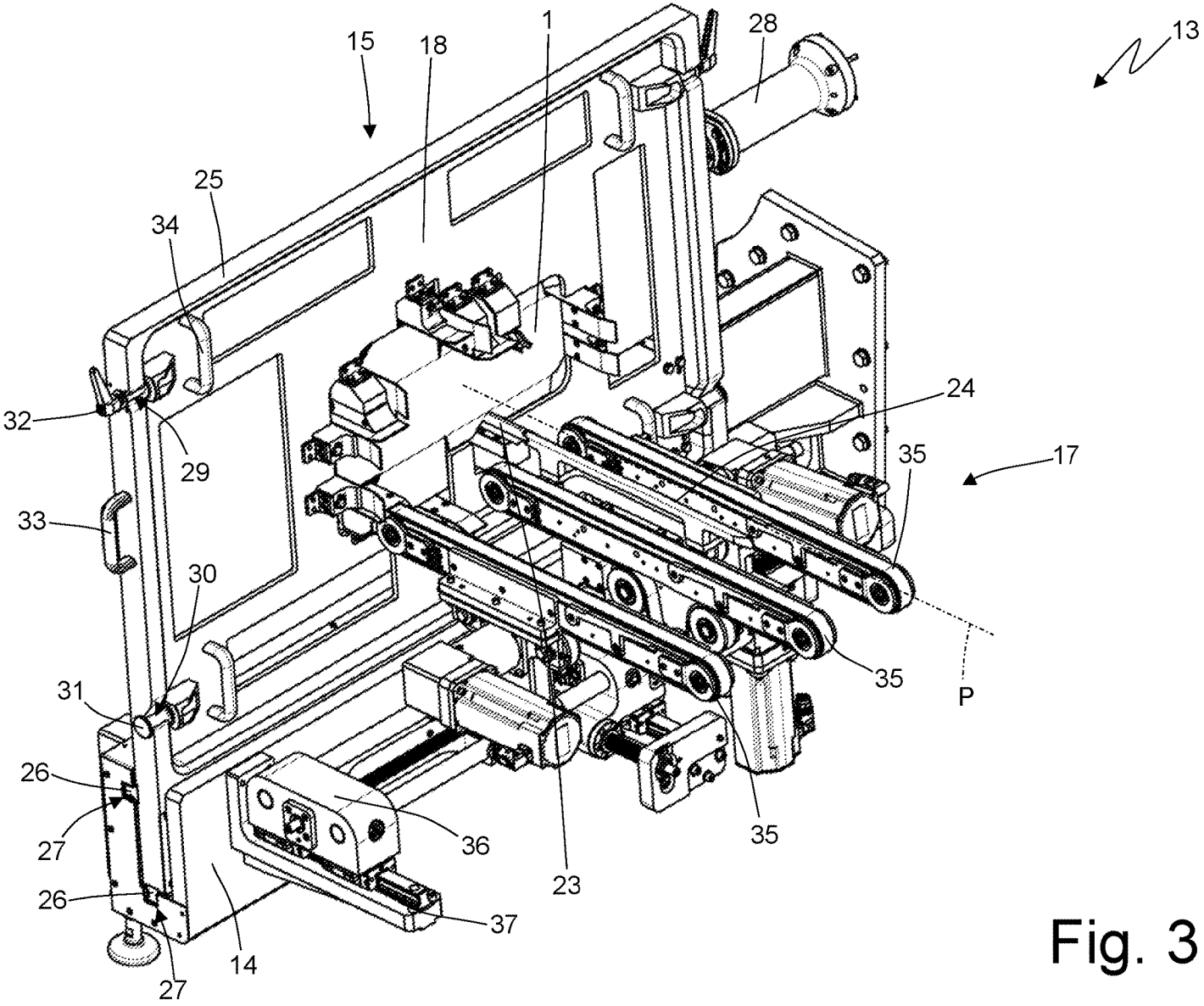
FIG. 3 is a rear perspective view of a blank feeding unit for a packer machine and containing a stack of blanks.

In FIG. 3, number 1 indicates, as a whole, a blank feeding unit 1 to feed blanks 1 in a packer machine designed to pack coffee capsules. In particular, the packer machine comprises the feeding unit 13, which retrieves single blanks 1 from a stack of blanks 1, a packing unit, which receives the single blanks 1 from the feeding unit 13 and folds the blanks 1 so as to form empty and open packs (namely, having the upper wall lifted relative to the rest of the pack), a filling unit, where robotic arms insert single coffee capsules into the open packs, and a closing unit, where the filled packs are closed (namely, the upper wall is caused to rest against and be glued to the rest of the pack).

Figure 5:
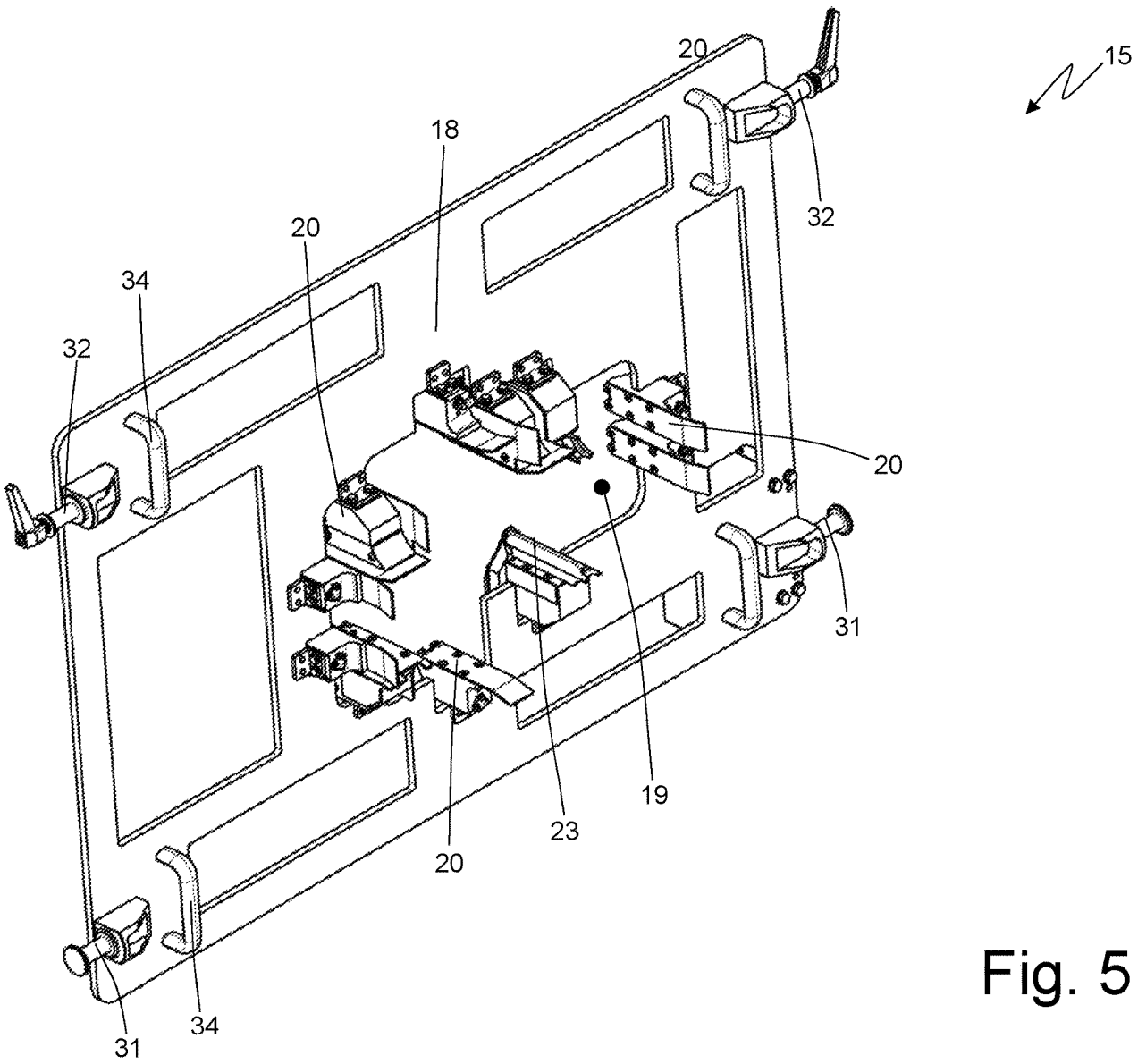
FIG. 5 is a rear perspective view of a hopper of the feeding unit of FIG. 3 without the stack of blanks.

According to FIG. 3, the feeding unit 13 comprises a frame 14, which rests on the ground by means of feet, and a hopper 15, which is carried by the frame 14, is designed to contain a stack of blanks 1 and has a pick-up opening 16 (visible for example in FIG. 5), through which one blank 1 at a time can be retrieved from the stack of blanks 1. Furthermore, the feeding unit 13 comprises a conveyor 17, which is supported by the frame 14 and moves the blanks 1 along a straight and horizontal moving path P, which ends in the hopper 15; the moving path P could also be inclined relative to the horizontal so as to have a (small or great) inclination oriented towards the hopper 15 so that gravity tends to move the blanks 1 towards the hopper 15. Finally, the feeding unit 13 comprises a pick-up device (not shown), which is arranged in the area of the pick-up opening 16 of the hopper 15 so as to engage, in use, the pick-up opening 16 in order to retrieve single blanks 1 from the stack one after the other and feed the blanks 1 towards the packing unit.

The pick-up device (not shown) comprises a rotary drum rotating around a central axis of its and at least one sucking holding head, which is supported by the drum so as to cyclically move along a closed path and through a holding station, where the holding head engages the pick-up opening 16 of the hopper 15 in order to retrieve a blank 1, and through a following release station, where the holding head feeds the blank 1 to the packing unit. Since (as better described below) the dimensions of the pick-up opening 16 are smaller than the dimensions of a blank 1 (so as to hold, in the absence of the pick-up device, the blanks 1 inside the hopper 15), a blank 1 needs to elastically deform in order to be extracted from the pick-up opening 16 of the hopper 15.

The hopper 15 comprises a flat containing wall 18 with a rectangular shape (arranged approximately perpendicularly to the moving path P), which has, at the centre, a through hole 19 (better visible in FIGS. 5, 6 and 7) having dimensions that are larger than the dimensions of the blanks 1, so that the blanks 1 can go through the hole 19 with a given (relatively large) clearance. According to FIGS. 6-9, the hopper 15 comprises a plurality of support brackets 20, which are designed to support (on all sides) the stack of blanks 1, are arranged around the hole 19 and are mounted on the containing wall 18; in other words, the support brackets 20 define a channel that goes through the hole 19 and houses the stack of blanks 1 with a minimum clearance. Furthermore, the hopper 15 comprises a plurality of holding teeth 21 and 22, which project into the pick-up opening 16 so as to prevent the blanks 1 from getting out and are mounted on the containing wall 18; in other words, the holding teeth 21 and 22 extend into the pick-up opening 16 so as to reduce the passage section of the pick-up opening 16 and hold the blanks 1 of the stack inside the hopper 15. Hence, the holding teeth 21 and 22 allow the pick-up opening 16 to gain dimensions that are smaller than the dimensions of a blank 1 so as to hold, in the absence of the action of the pick-up device, the blanks 1 inside the hopper 15. According to a preferred embodiment, the holding teeth 21 and 22 are mounted on the support brackets 20, which, in turn, are mounted on the containing wall 18; namely, each support bracket 20 directly fixed to the containing wall 18 supports, in turn, corresponding holding teeth 21 and 22.

The hopper 15 comprises a reference element 23, which, in use is arranged in contact with the stack of blanks 1 and establishes a position reference for the blanks 1 of the stack of blanks 1; in particular, the reference element 23 establishes the position of the vertex 12 of each blank 1. Namely, the position reference established by the reference element 23 is configured to be in contact with the same point of each blank 1 regardless of the format of the blank 1. In particular, the reference element 23 has, in cross section, a triangular shape and has an upper vertex, which establishes the position reference and is indirect contact with the stack of blanks 1; namely, the vertex of the triangular shape of the cross section of the reference element 23 is in direct contact with the vertex 12 of each blank 1 so as to establish the position of the vertex 12 of each blank 1. According to a preferred embodiment, the reference element 23 is mounted on the containing wall 18 and, hence, is integral to the hopper 15.

As mentioned above, there are blanks 1 (all having the same conformation, namely the same arrangement of panels and wings) with different formats (namely, different sizes), so as to manufacture corresponding packs having smaller or larger dimensions; as a consequence, the feeding unit 13 needs to be adjusted so as to be able to contain blanks 1 with a different format by means of a format change operation (which obviously involves the entire packer machine). In other words, when the packer machine has to produce packs with a different format (difference size), it is necessary to stop the packer machine, empty the packer machine from the blanks 1 of the old format, adjust the entire packer machine (hence, also the feeding unit 13 of the packer machine) to the new format and, finally, insert the blanks 1 of the new format. As a consequence, in order to contain blanks 1 with different formats, the feeding unit 13 can be adjusted by means of a format change operation, which entails changing the feeding unit 13 from a first (old) configuration, which is suited to contain a first (old) format of the blanks 1, to a second (new) configuration, which is suited to contain a second (new) format of the blanks 1, which is different from the first (old) format.

The reference element 23 of the hopper 15 is arranged, in use, in contact with the stack of blanks 1, establishes a position reference for the blanks 1 of the stack of blanks 1

(establishing the position of the vertex 12 of each blank 1), is—relative to the frame 14—in the same position regardless of the format of the blanks 1 and, hence, is not moved—relative to the frame 14—due to a format change operation. In other words, at the end of all format change operations, the reference element 23 of the hopper 15 always is in the same position relative to the frame 14, so that, regardless of the format (size) of the blanks 1, the vertex 12 of each blank 1 always is in the same position relative to the frame 14. According to FIGS. 3, 4 and 10, the feeding unit 13 comprises a reference element 24, which has, in cross section, the same shape as the reference element 23, is aligned with the reference element 23 so as to build an extension of the reference element 23, is separate from and independent of the hopper 15 and the reference element 23, is arranged along the moving path P in the area of the conveyor 17 and is mounted on the frame 14 in the same position regardless of the format of the blanks 1 (exactly like the reference element 23) and, hence, is not moved, relative to the frame 14, due to a format change operation. In other words, during a format change operation, all the other adjustable elements of the feeding unit 13 are moved relative to the frame 14, but the two reference elements 23 and 24, on the other hand, always remain in the same position relative to the frame 14 (obviously, net of unavoidable constructive tolerances). The reference element 23 is an extension (without gaps) of the reference element 24 inside the hopper 15, whereas, from another point of view, the reference element 24 is an extension (without gaps) of the reference element 23 inside the conveyor 17.

According to a different embodiment which is not shown herein, the reference elements 23 and 24 could coincide, if the reference element 23 were long enough to also incorporate the function of the reference element 24 or vice versa; in other words, the two reference elements 23 and 24, instead of being separate and independent, could build one single indivisible body.

As schematically shown in FIG. 2, the feeding unit 13 comprises a plurality of hoppers 15, which are different from one another and interchangeable, each of them being associated with a corresponding format (size) of the blanks 1; in other words, an equipment (a kit) for the feeding unit 13 is provided, which comprises a plurality of different and interchangeable hoppers 15, each associated with a corresponding format of the blanks 1. As a consequence, each hopper 15 is designed and adjusted so as to only treat one single corresponding format of the blanks 1; hence, during a format change operation, the old hopper 15, which is suited for the old format (size) of the blanks 1 has to be removed and, then, the new hopper 15, which is suited for the new format (size) of the blanks 1, has to be installed.

In order to allow for a quick replacement of the hopper 15 during a format change operation, the hopper 15 is fixed to the frame 14 in a quickly removable manner (since the format change operation entails replacing an old hopper 15 associated with the old format with a new hopper 15 associated with the new format).

Figure 4:
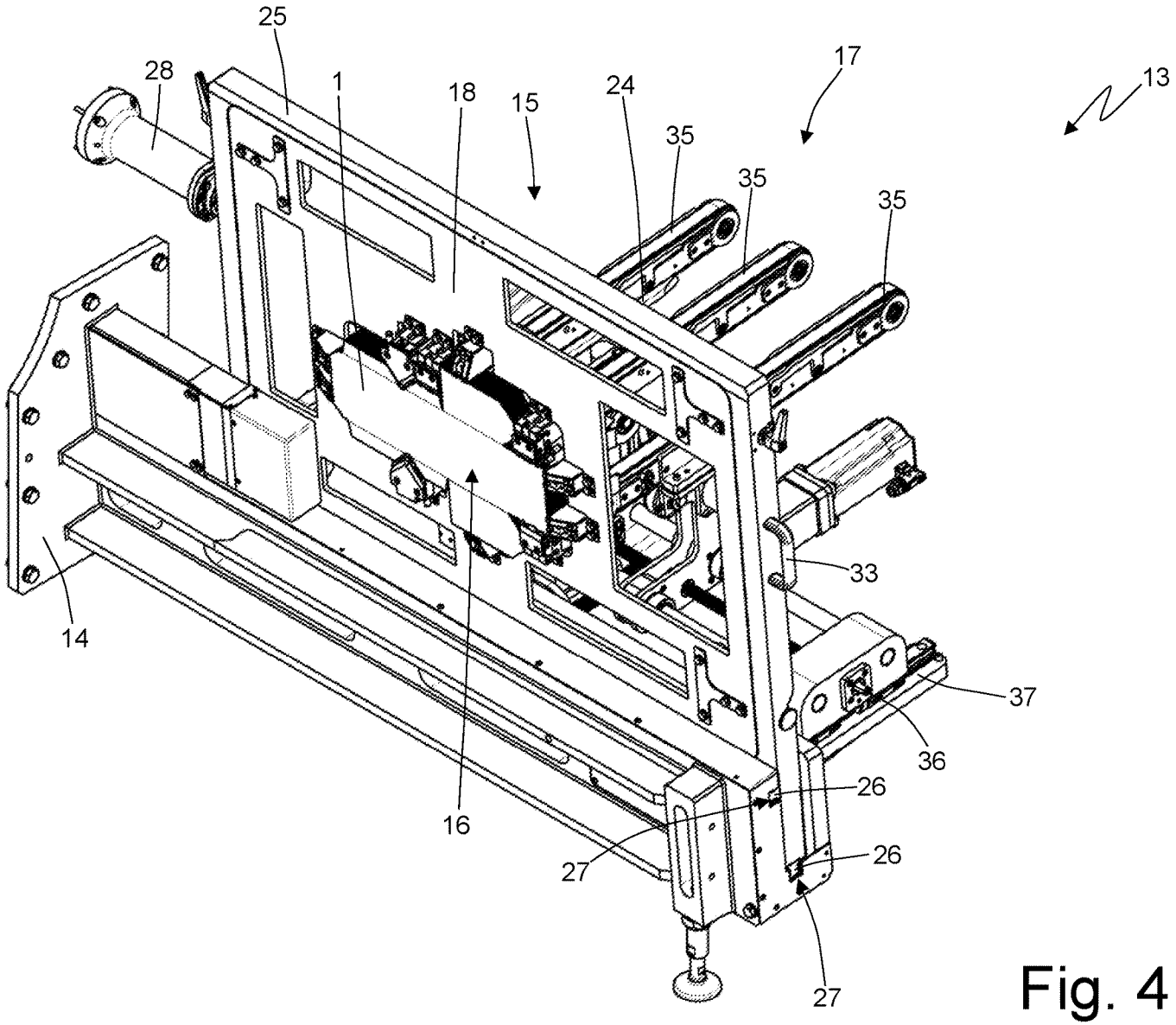
FIG. 4 is a front perspective view of the feeding unit of FIG. 3 and containing the stack of blanks.

According to a preferred embodiment shown in FIGS. 3 and 4, the frame 14 comprises a support body 25, which is provided with a seat designed to house the hopper 15. In particular, the seat of the support body 25 reproduces in negative the (rectangular) shape of the containing wall 18 of the hopper 15 so as to house, on the inside, the containing wall 18; as a consequence, the support body 25 is shaped like a rectangular frame, within which the containing wall 18 of the hopper 15 is placed.

The support body 25 is movable on the frame 14 so as to move, during a format change operation, between a work position (shown in FIGS. 3 and 4), in which the hopper 15 housed in the support body 25 is coupled to and aligned with the conveyor 17, and a replacement position (shown in FIG. 10), in which the hopper 15 housed in the support body 25 is uncoupled from and not aligned with the conveyor 17. In the replacement position (shown in FIG. 10), the hopper 15 housed in the support body 25 is relatively far from the conveyor 17 and from the other components of the feeding unit 13 and, hence, is in an obstacle-free space, which largely facilitates both the operations to be carried out in order to remove the old hopper 15 from the support body 25 and the operations to be carried out in order to install the new hopper 15 in the support body 25. In particular, the frame 14 comprises two carriages 26 carrying the support body 25 and two corresponding sliding guides 27 (oriented horizontally and perpendicularly to the moving path P), a corresponding carriage 26 sliding along each one of them so as to move the support body 25 between the work position (shown in FIGS. 3 and 4) and the replacement position (shown in FIG. 10).

According to a preferred embodiment, the feeding unit 13 comprises a locking device 28, which can be electrically operated in a remote manner and can be activated in order to constrain the support body 25 (carrying the hopper 15) to the frame 14 when the support body 25 is in the work position (shown in FIGS. 3 and 4); namely, the locking device 28 can be activated so as to prevent the support body 25 (carrying the hopper 15) from moving when the feeding unit 13 is operating. By way of example, the locking device 28 could have a pneumatic actuation and could comprise a mushroom-shaped pin, which is fixed to an edge of the support body 25, and a servo-assisted clamp mechanism, which is designed to clamp the pin so as to constrain the pin and, hence, the support body 25 to the frame 14.

Preferably, the support body 25 has two upper seats 29 and two lower seats 30 (partially visible in FIG. 3); furthermore, each hopper 15 comprises two pins 31 (better shown in FIG. 5), which project from opposite ends of the containing wall 18 and are configured to be inserted into the corresponding lower seats 30, and comprises two hooking mechanisms 32 (better shown in FIG. 5 and manually operated by means of respective levers), which project from opposite ends of the containing wall 18, are configured to be inserted into the corresponding upper seats 29 and can be operated (in a manual manner, by rotating the respective levers) so as to constrain the containing wall 18 to the support body 25. A hopper 15 is coupled to the support body 25 by inserting, at first, only the two pins 31 into the corresponding lower seats 30 of the support body 25, then by causing the hopper 15 to rotate around the pins 31 until the hooking mechanisms 32 are inserted into the corresponding upper seats 29 and, finally, by (manually) operating the hooking mechanisms 32 so as to constrain the hopper to the support body 25.

Figure 10:
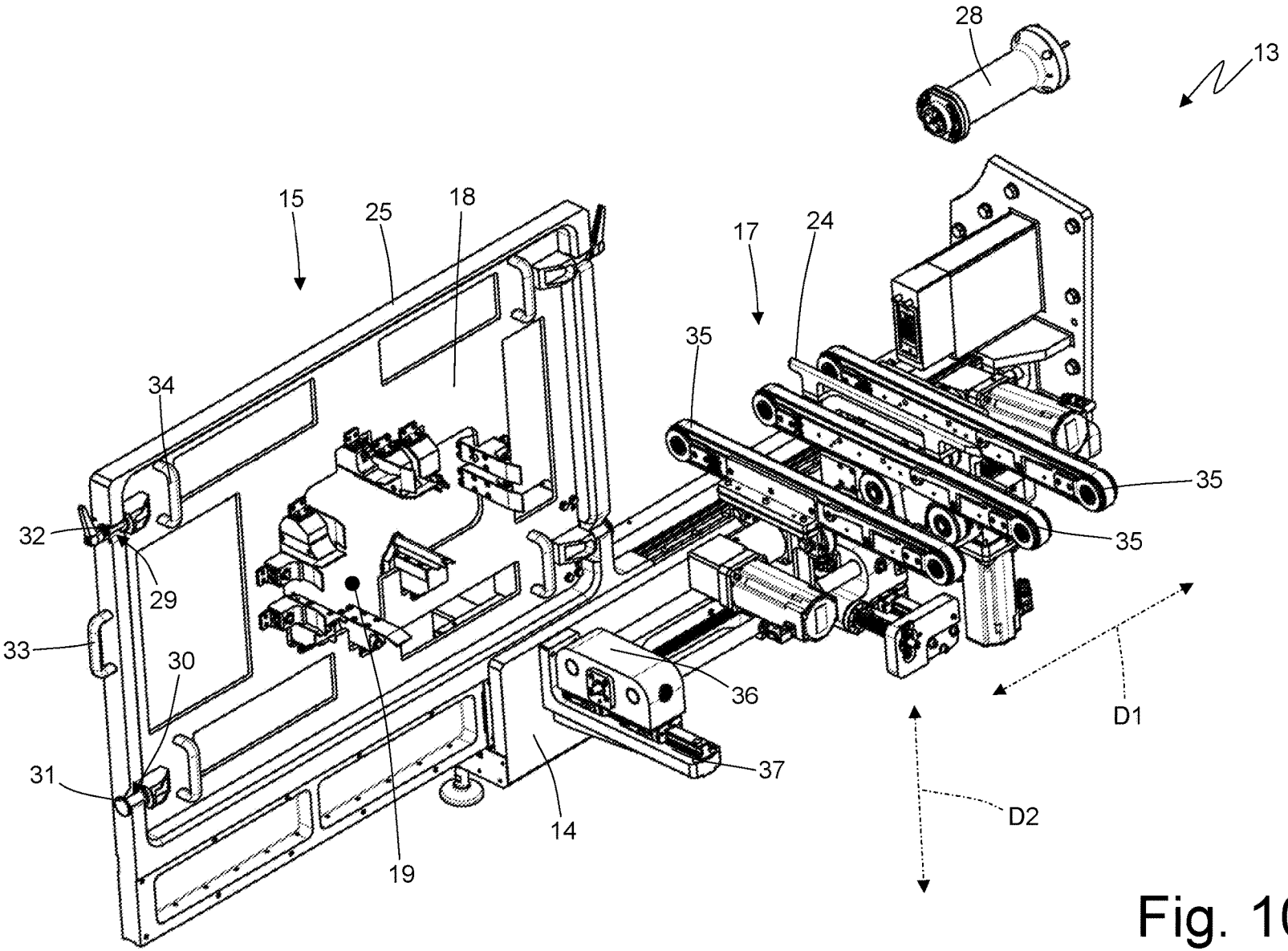
FIG. 10 is a rear perspective view of the feeding unit of FIG. 3 without the stack of blanks and with a support body in a replacement position.

Preferably, the support body 25 has a handle 33, which can be grabbed by a user in order to push or pull the support body 25 when the support body 25 needs to be (manually) moved between the work position (shown in FIGS. 3 and 4) and the replacement position (shown in FIG. 10). Similarly, each hopper 15 has a series of handles 34, which are fixed to the containing wall 18 of the hopper 15 and can be grabbed by a user in order to manually handle the hopper 15. In order to make the hopper 15 lighter and, hence, make the manual handling of the hopper 15 easier, the containing wall 18 has a series of lightening through holes; furthermore, the containing wall 18 is generally made of a light and resistant material, such as for example an aluminium alloy or a composite material (for example a carbon fibre-based material).

According to FIG. 10, the conveyor 17 comprises three motor-driven conveyor belts 35, which are parallel and next to one another along the moving path P, are mounted on the frame 14 and are arranged under the blanks 1 so as to support the blanks 1. Each conveyor belt 35 comprises a belt closed in a ring shape around two end pulleys; an end pulley is an idle pulley, whereas the other end pulley is motor-driven and receives the motion from a corresponding electric motor. Preferably, the conveyor belts 35 have independent electric motors, namely each conveyor belt 35 is moved by an independent electric motor of its own; in this way, the moving speed of the three conveyor belts 35 can be adjusted in a differentiated manner.

According to a preferred embodiment, each conveyor belt 35 is mounted on the frame 14 in a movable manner so as to move, during a format change operation, along at least two adjustment directions D1 and D2, which are perpendicular to one another and perpendicular to the moving path P; in particular, the adjustment direction D1 is horizontal, whereas the other adjustment direction D2 is vertical.

According to a preferred embodiment, for each conveyor belt 35, the conveyor 17 comprises (at least) a carriage, which (indirectly) supports the conveyor belt 35, and a sliding guide (typically consisting of two rods parallel to one another), which is oriented parallel to the adjustment direction D1 and along which the carriage slides in order to move the conveyor belt 35 along the adjustment direction D1; in particular, there is an electric motor (namely, an electrically controlled actuator), which controls the movement of the carriage along the sliding guide and, for example, is mechanically coupled to the carriage by means of a screw-nut screw coupling (the screw is caused to rotate by the electric motor, thus determining the axial translation of the nut screw, which engages the screw and is integral to the carriage). A further screw-nut screw coupling is mounted on the carriage: the screw oriented along the vertical adjustment direction D2 is caused to rotate by a further electric motor, thus determining the axial translation of the nut screw, which engages the screw and supports the conveyor belt 35.

According to a preferred embodiment, the entire conveyor 17 (namely, the three conveyor belts 35 with all corresponding mechanisms for the translation along the two adjustment directions D1 and D2) is mounted on the frame 14 in a movable manner so as to move, during a format change operation, between a work position (shown in FIG. 3), in which the conveyor 17 is coupled to the hopper 15, and a replacement position (shown in FIG. 10), in which the conveyor 17 is uncoupled and at a given distance from the hopper 15; in particular, the movement of the conveyor 17 between the work position (shown in FIG. 3) and the replacement position (shown in FIG. 10) takes place through a horizontal translation parallel to the moving path P (hence, perpendicular to the adjustment directions D1 and D2). The main purpose of the movement of the conveyor 17, which only takes place during a format change, is that of moving the conveyor 17 away from the hopper 15 so as to remove all possible couplings between the conveyor 17 and the hopper 15 and, hence, subsequently allow the support body 25 (carrying the hopper 15) to slide. A further purpose of the movement of the conveyor 17, which only takes place during a format change, is that of moving the conveyor 17 away from the hopper 15 so as to create a larger free space around the hopper 15 and, hence, facilitate the replacement of the hopper 15.

Figure 11:
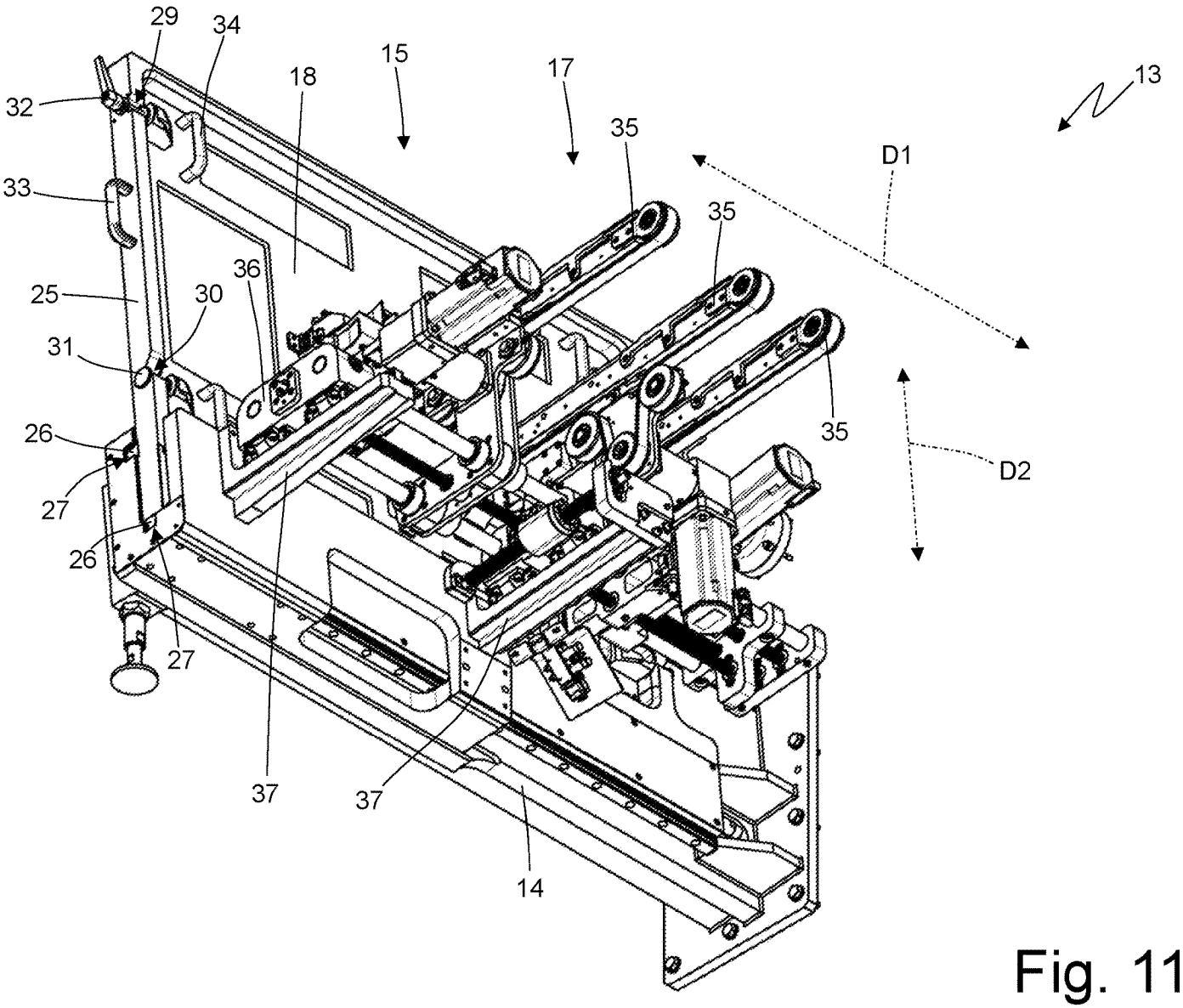
FIG. 11 is a different rear perspective view of the feeding unit of FIG. 3 without the stack of blanks.

According to a preferred embodiment shown in FIG. 11, the feeding unit 13 comprises two carriages 36, which support the entire conveyor 17 (namely, the three conveyor belts 35 with all corresponding mechanisms for the translation along the two adjustment directions D1 and D2), and two sliding guides 37, which are oriented parallel to the moving path P and along which the carriages 36 slide in order to move the entire conveyor 17 between the work position (shown in FIG. 3) and the replacement position (shown in FIG. 10); in particular, there is an electric motor (namely, an electrically controlled actuator), which controls the movement of the carriages 36 along the sliding guide 37 and, for example, is mechanically coupled to the carriages 36 through a screw-nut screw coupling (the screw is caused to rotate by the electric motor, thus determining the axial translation of the nut screw, which engages the screw and is integral to one of the carriages 36).

Figure 6:
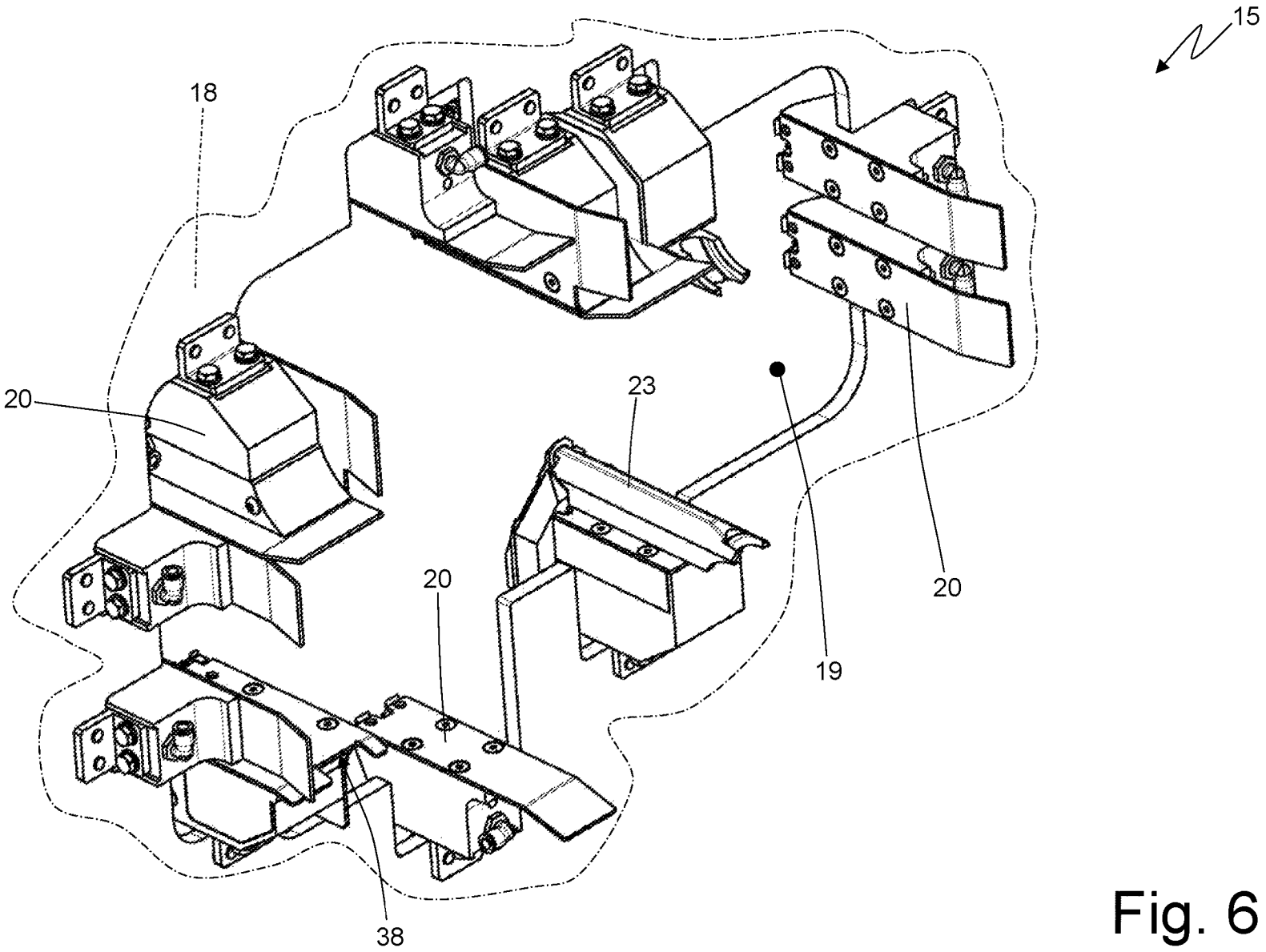
FIGS. 6, 7 and 8 are a rear perspective view, a front perspective view and a front view, respectively, of part of the hopper of FIG. 5.
Figure 7:
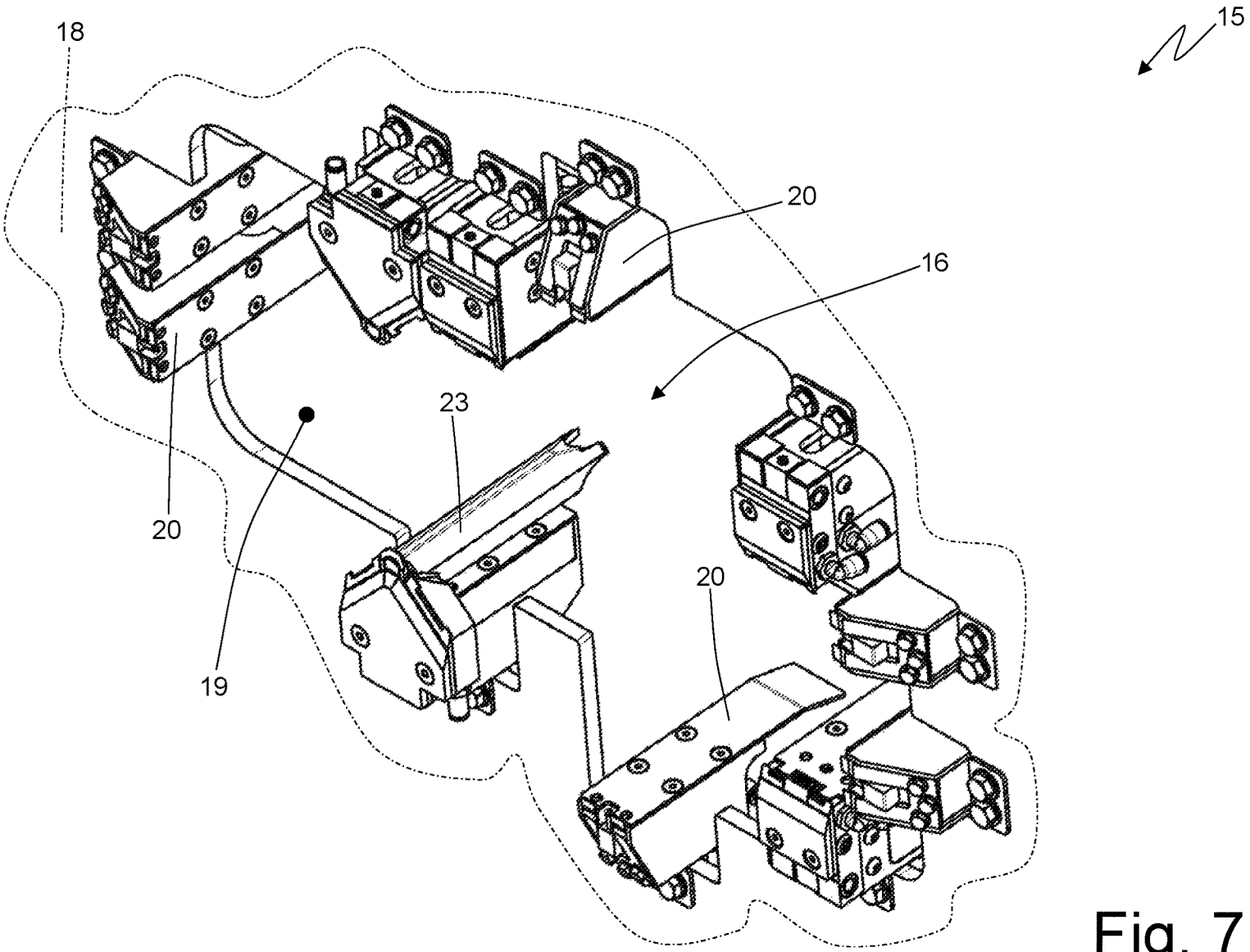

According to FIG. 6, the hopper 15 comprises (at least) a support bracket 20, which projects towards a corresponding conveyor belt 35 of the conveyor 17, provides support for the stack of blanks 1 along an end segment of the moving path P and has a "U"-shape, which defines, at the centre, a seat 38, into which an end part of the conveyor belt 35 is inserted. The movement of the conveyor 17, which only takes place during a format change, allows the corresponding conveyor belt 35 to be moved away from the seat 38 so as to subsequently allow the support body 25 (carrying the hopper 15) to slide.

Figure 8:
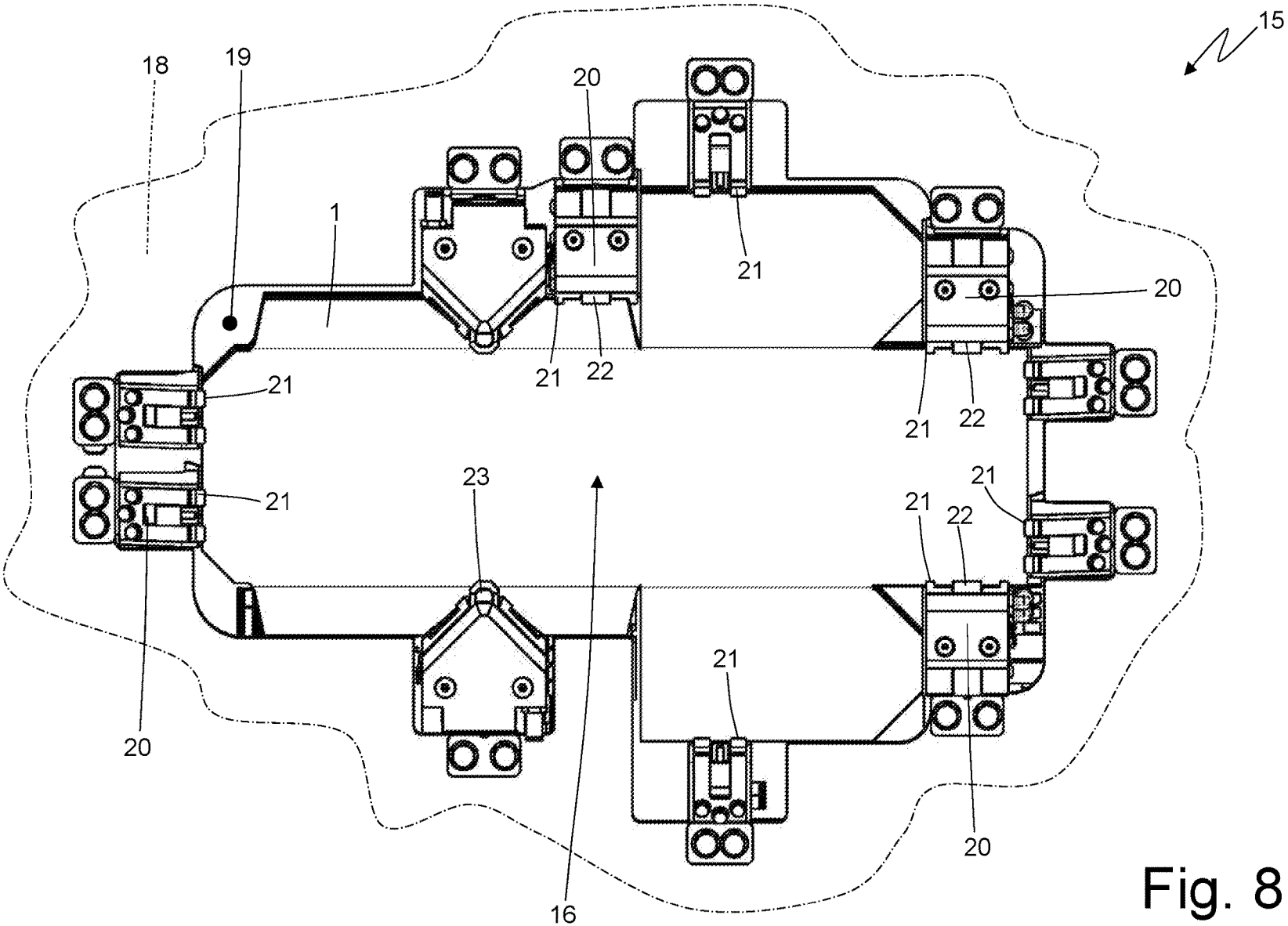
Figure 9:
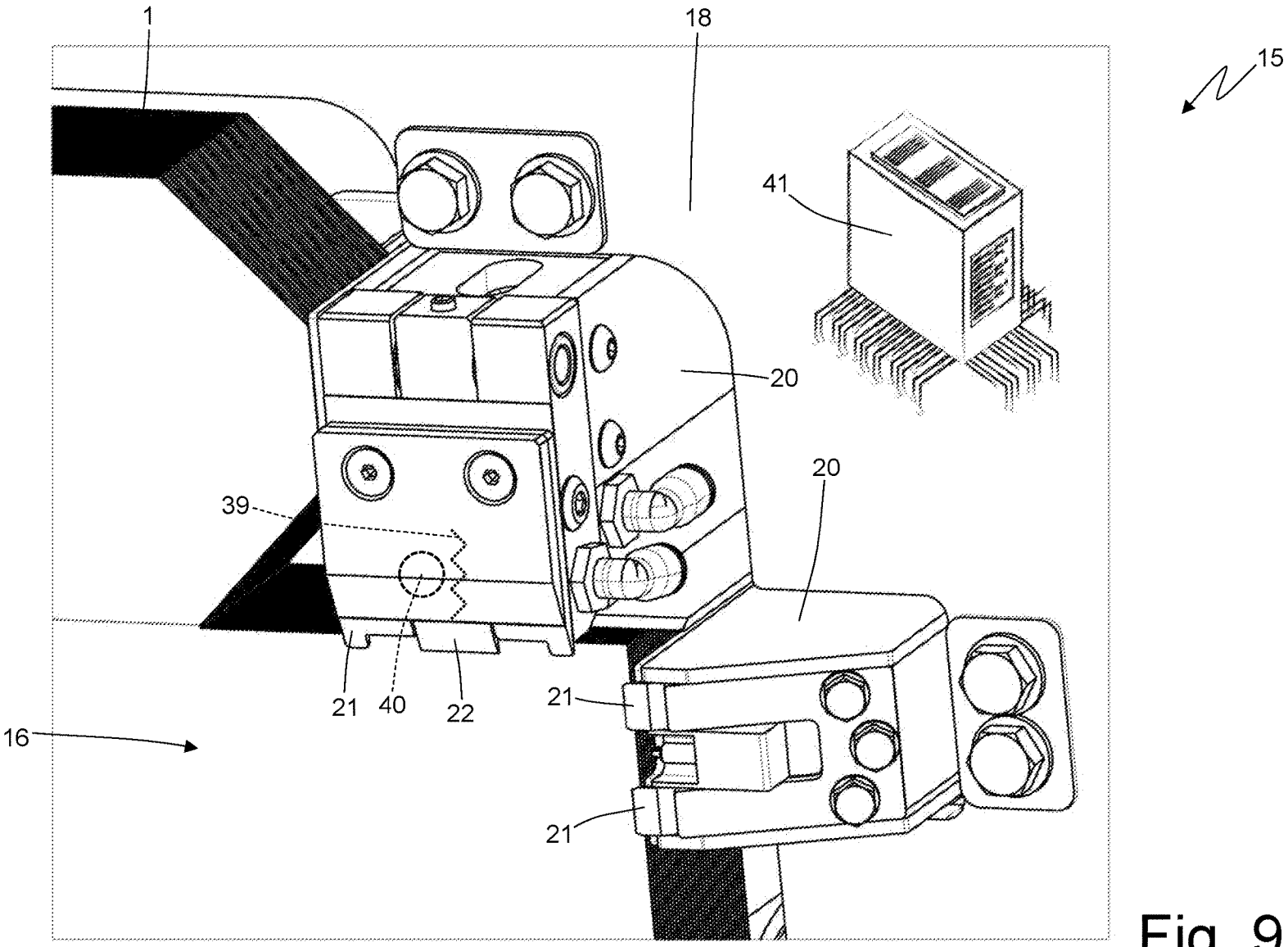
FIG. 9 is a front perspective view of a detail of FIG. 7.

According to FIGS. 8 and 9, the hopper 15 supports a plurality of fixed holding teeth 21, which project into the pick-up opening 16 in order to prevent the blanks 1 from getting out; the fixed holding teeth 21 are mounted in a fixed position, namely are mounted so as not to make any type of movement.

Furthermore, according to FIGS. 8 and 9, the hopper 15 also supports three movable holding teeth 22, which project into the pick-up opening 16 in order to prevent the blanks 1 from getting out through the pick-up opening 16; unlike the fixed holding teeth 21 (which do not make any type of movement and always remain in the same position), each movable holding tooth 22 is mounted so as to move between an extracted position (shown in the accompanying figures), in which it projects into the pick-up opening 16 to a greater extent, and a retracted position (not shown), in which it projects into the pick-up opening 16 to a smaller extent.

In particular, for each movable holding tooth 22 there is an elastic element 39, which pushes the holding tooth towards the extracted position (shown in the accompanying figures), and each movable holding tooth 22 is associated with a position sensor 40, which is configured to detect the position of the movable holding tooth 22. The feeding unit 13 comprises a control unit 41 (schematically shown in FIG. 9), which is configured to adjust the moving speed of the conveyor 17 (namely, of the conveyor belts 35 of the conveyor 17) depending on the reading received from the position sensor 40. In particular, the control unit 41 is configured to adjust the moving speed of the conveyor belts 35 so that the movable holding teeth 22 move with a synchronized motion (namely, move with a predetermined and desired time sequence) during the pick-up of a blank 1. For example, if, during the pick-up of a blank 1, a movable holding tooth 22 on the right moves with too much advance/delay relative to the other holding teeth 22, then the right conveyor belt 35 is slowed down/accelerated.

The format change operations to be carried out to change the feeding unit 13 from an old configuration suited to contain an old format (size) of the blanks 1 to a new configuration suited to contain a new format (size) of the blanks 1 are described below.

At first, the packer machine is stopped and then the feeding unit 13 is stopped as well; when the feeding unit 13 has stopped, the old blanks 1 are removed from the feeding unit 13 and, when the feeding unit 13 is empty (namely, without blanks 1), the conveyor 17 is moved (through the action of a corresponding electric motor) from the work position (shown in FIG. 3) to the replacement position (shown in FIG. 10).

Only when the conveyor 17 is in the replacement position (shown in FIG. 10), the locking device 28 can be operated so as to release (free) the support body 25 (carrying the old hopper 15) from the frame 14. At this point, an operator manually causes the support body 25 to slide from the work position (shown in FIGS. 3 and 4) to the replacement position (shown in FIG. 10); when the support body 25 is in the replacement position (shown in FIG. 10), an operator can remove the old hopper 15 associated with the old format (size) of the blanks 1 from the support body 25 and, then, can install the new hopper 15 associated with the new format (size) of the blanks 1 on the support body 25.

Usually at this point (but this could also take place before or after), the control unit 41 changes the position of the conveyor belts 35 of the conveyor 17 along the adjustment directions D1 and D2 (using the corresponding electric motors) so as to adjust the position of the conveyor belts 35 to the new format (size) of the blanks 1.

At the end of the replacement of the hopper 15 and of the adjustment of the conveyor belts 35 of the conveyor 17, an operator can manually cause the support body 25 to slide form the replacement position (shown in FIG. 10) to the work position (shown in FIGS. 3 and 4); when the support body 25 is in the work position (shown in FIGS. 3 and 4), the locking device 28 is operated so as to constrain (lock) the support body 25 (carrying the new hopper 15) to the frame 14. Only when the support body 25 is constrained to the frame 14 in the work position (shown in FIGS. 3 and 4), the conveyor 17 can be moved (through the action of a corresponding electric motor) from the replacement position (shown in FIG. 10) to the work position (shown in FIG. 3).

Finally, the blanks 1 of the new format are loaded into the feeding unit 13, thus completing the format change operations.

As mentioned above, during all format change operations, both reference elements 23 and 24 remain in the same position relative to the frame 14, namely they do not change the position of the position reference established by them relative to the frame 14 (obviously, net of inevitable constructive tolerances). In particular, the reference element 23 is replaced (as it is mounted on the hopper 15), but, switching from the old hopper 15 to the new hopper 15, the position of the reference element 23 relative to the frame 14 does not change (i.e. the reference element 23 of the new hopper 15 is exactly in the same position as the reference element 23 of the old hopper 15). The reference element 24 could be replaced or not be replaced (in order to adjust its shape to the different conformation of the blanks 1), but, even in case of replacement of the reference element 24, the position of the reference element 24 does not change during the replacement (i.e. the new reference element 24 is exactly in the same position as the old reference element 24).

In the preferred embodiment shown in the accompanying figures, the conveyor 17 is active, namely it has motor-driven elements (the conveyor belts 35) that push the blanks 1 along the moving path P; according to a different embodiment, the conveyor 17 is passive, namely it has no motor-driven elements, and exclusively uses gravity to push the blanks 1 along the moving path P (which must obviously be inclined relative to the horizontal).

In the preferred embodiment shown in the accompanying figures, the packer machine manufactures packs for coffee capsules. According to other embodiments which are not shown herein, the packer machine manufactures packs for food products, for smoking products, for personal hygiene articles or other products.

The embodiments described herein can be combined with one another, without for this reason going beyond the scope of protection of the invention.

The feeding unit 13 described above has numerous advantages.

First of all, the feeding unit 13 described above significantly reduces the reconfiguration times needed to adjust to a new format (size) of the blanks 1; namely, the feeding unit 13 described above minimizes the time needed to carry out a format change, which entails changing the feeding unit 13 from an old configuration suited to contain an old format (size) of the blanks 1 to a new configuration suited to contain a new format (size) of the blanks 1.

This result is obtained thanks to the fact that there are a plurality of different and interchangeable hoppers 15, each associated with a corresponding format (size) of the blanks 1; therefore, during format change operations, the whole hopper 15 is entirely replaced and the new hopper 15 installed already is perfectly set and adjusted for the corresponding format (size) of the blanks 1, with no need for any additional adjustment. Furthermore, this result is also obtained thanks to the fact that the hopper 15 has a reference element 23, which, in use, is placed in contact with the stack of blanks 1, establishes a position reference for the blanks 1, is, relative to the frame 14, in the same position regardless of the format (size) of the blanks 1 and, hence, is not moved, relative to the frame 14, due to a format change operation. The presence of the reference element 23 ensures that, each time the hopper 15 is replaced, the new hopper 15 finds the blanks 1 in a position known beforehand and, therefore, all the adjustment previously made to the hopper 15 still are completely valid and do not need to be changed (updated).

As a consequence, format change operation only require the replacement of the hopper 15 (which can be carried out in a few minutes thanks to the particular conformation of the hopper 15), but not other adjustment has to be made to the holding teeth 21 and 22 (which are the holding elements arranged in the area of the pick-up opening 16), as each hopper 15 (and, hence, the holding teeth 21 and 22 thereof) is associated with (and, hence, already adjusted to) one single corresponding format (size) of the blanks 1.

Furthermore, the feeding unit 13 described above is simple and economic to be manufactured, since it does not require complicated mechanical pieces.

The invention also proves advantageous in the use of a method to carry out a format change in the feeding unit 13, in particular to adjust the feeding unit 13 from the first format of the blanks 1 to the second format of the blanks 1. The method preferably comprises the step of changing the configuration of the feeding unit 13 keeping, at the end of the configuration changing step, the first reference element 23 in the same position relative to the frame 14. The method preferably comprises the steps of removing a first hopper 15 associated with the first format of the blanks 1 and, then, mounting a second hopper 15, which is different from the first hopper 15 and is associated with the second format of the blanks 1.

LIST OF THE REFERENCE NUMBERS OF THE FIGURES

1 blank
2 longitudinal folding lines
3 transverse folding lines
4 panel
5 panel
6 panel
7 panel
8 panels
9 lid
10 wings
11 wings
12 vertex
13 feeding unit
14 frame
15 hopper
16 pick-up opening
17 conveyor
18 containing wall
19 through hole
20 support brackets
21 fixed holding teeth
22 mobile holding teeth
23 reference element
24 reference element
25 support body
26 carriage
27 sliding guide
28 locking device
29 upper seats
30 lower seats
31 pins
32 hooking mechanisms
33 handle
34 handle
35 conveyor belt
36 carriage
37 sliding guide
38 seat
39 elastic element
40 position sensor
41 control unit
P moving path
D1 adjustment direction
D2 adjustment direction

The invention claimed is:

1. A unit (13) to feed blanks (1) in a packer machine and comprising:

a frame (14);

a hopper (15), which is supported by the frame (14), is designed to hold a stack of blanks (1) and has a pick-up opening (16), through which one blank (1) at a time can be picked up from the stack of blanks (1); and a conveyor (17), which is supported by the frame (14) and moves the blanks (1) along a moving path (P), which ends in the hopper (15);

wherein, in order to contain blanks (1) with different formats, the feeding unit (13) can be adjusted by means of a format change operation, which entails changing the feeding unit (13) from a first configuration, which is suited to contain a first format of the blanks (1), to a second configuration, which is suited to contain a second format of the blanks (1), which is different from the first format;

wherein the hopper (15) comprises a first reference element (23), which, in use, is placed in contact with the stack of blanks (1), establishes a position reference for the blanks (1) of the stack of blanks (1), is, relative to the frame (14), in the same position regardless of the format of the blanks (1) and, hence, is not moved, relative to the frame (14), due to a format change operation;

wherein the hopper (15) supports at least two movable holding teeth (22), which project into said prick-up opening (16) in order to prevent the blanks (1) from getting out through the pick-up opening (16);

wherein each movable holding tooth (22) can move between an extracted position, in which it projects into the pick-up opening (16) to a greater extent, and a retracted position, in which it projects into the prick-up opening (16) to a smaller extent;

wherein for each movable holding tooth (22) there is an elastic element (39), which pushes the holding tooth towards the extracted position;

wherein each movable holding tooth (22) is associated with a position sensor (40), which is configured to detect the position of the movable holding tooth (22); and wherein a control unit (41) is provided, which is configured to adjust the moving speed of the conveyor (17) depending on the information received from the position sensors (40).

2. The feeding unit (13) according to claim 1, wherein each blank (1) comprises two longitudinal folding lines (2);

a plurality of transverse folding lines (3), which define, between the two longitudinal folding lines (2), a plurality of panels (4-7);

two first wings (10), which are connected to a first longitudinal folding line (2); and two second wings (11), which are connected to a second longitudinal folding line (2);

wherein the first wings (10) delimit, between one another, an empty space with a triangular shape, which has a vertex (12) in the area of the first longitudinal folding line (2); and wherein the first reference element (23) is placed and shaped in such a way that the position reference in located in the area of the vertex of the empty space (12) defined between the first wings (10).

3. The feeding unit (13) according to claim 1, wherein the first reference element (23) has, in cross section, a triangular shape and has an upper vertex, which establishes the position reference and is in direct contact with the stack of blanks (1).

4. The feeding unit (13) according to claim 1, and comprising a second reference element (24), which is aligned with the first reference element (23) so as to build an extension of the first reference element (23), is separate from and independent of the hopper (15) and the first reference element (23), is arranged along the moving path (P) in the area of the conveyor (17) and is mounted on the frame (14) in the same position regardless of the format of the blanks (1) and, hence, is not moved, relative to the frame (14), due to a format change operation.

5. The feeding unit (13) according to claim 1, wherein:

a plurality of different and interchangeable hoppers (15) is provided, each associated with a corresponding format of the blanks (1); and each hopper (15) is fixed to the frame (14) in a removable manner in order to be replaced during a format change operation so that the format change operation entails replacing a first hopper (15) associated with the first format with a second hopper (15) associated with the second format.

6. The feeding unit (13) according to claim 5, wherein the frame (14) comprises a support body (25), which is provided with a seat designed to house the hopper (15).

7. The feeding unit (13) according to claim 6, wherein:

the support body (25) has two upper seats (29) and two lower seats (30);

each hopper (15) comprises two pins (31), which are configured to be inserted into the corresponding lower seats (30); and each hopper (15) comprises two hooking mechanisms (32), which are configured to be inserted into the corresponding upper seats (29) and can be operated so as to lock the hopper (15) to the support body (25).

8. The feeding unit (13) according to claim 6, wherein the support body (25) is movable on the frame (14) so as to move, during a format change operation, between a work position, in which the hopper (15) housed in the support body (25) is coupled to and aligned with the conveyor (17), and a replacement position, in which the hopper (15) housed in the support body (25) is uncoupled from and not aligned with the conveyor (17).

9. The feeding unit (13) according to claim 8, wherein the frame (14) comprises:

at least one carriage (26) carrying the support body (25); and a horizontally oriented-sliding guide (27), along which the carriage (26) slides in order to move the support body (25) between the work position and the replacement position.

10. The feeding unit (13) according to claim 8 and comprising a locking device (28), which can be activated in order to lock the support body (25) to the frame (14) when the support body (25) is in the work position.

11. The feeding unit (13) according to claim 1, wherein:

the conveyor (17) comprises at least one conveyor belt (35), which is mounted on the frame (14) and is arranged under the blanks (1) so as to support the blanks (1); and the conveyor belt (35) is mounted on the frame (14) in a movable manner so as to move, during a format change operation, along at least one adjustment direction (D1), which is perpendicular to the moving path (P) along two adjustment directions (D1, D2), which are perpendicular to one another and perpendicular to the moving path (P).

12. The feeding unit (13) according to claim 11, wherein the conveyor (17) comprises:

at least one carriage carrying the conveyor belt (35); and a sliding guide, which is parallel to the adjustment direction (D1) and along which the carriage slides in order to move the conveyor belt (35) along the adjustment direction (D1).

13. The feeding unit (13) according to claim 1, wherein the conveyor (17) is mounted on the frame (14) in a movable manner so as to move, during a format change operation, between a work position, in which the conveyor (17) is coupled to the hopper (15), and a replacement position, in which the conveyor (17) is uncoupled and at a certain distance from the hopper (15).

14. The feeding unit (13) according to claim 13, wherein the hopper (15) comprises a support bracket (20), which projects towards a conveyor belt (35) of the conveyor (17), provides support for the stack of blanks (1) along an end segment of the moving path (P) and has a "U"-shape, which defines, at the centre, a seat (38), into which an end part of the conveyor belt (35) is inserted.

15. The feeding unit (13) according to claim 1, wherein:

the conveyor (17) comprises at least two conveyor belts (35), which are independent of and parallel to one another; and the control unit (41) is configured to adjust the moving speed of the two conveyor belts (35) so that the two movable holding teeth (22) move with a synchronized motion during the pick-up of a blank (1).

16. The feeding unit (13) according to claim 1, wherein the hopper (15) comprises:

a containing wall (18), which is perforated at the centre so as to be crossed by a stack of blanks (1); a plurality of support brackets (20), which are designed to support the stack of blanks (1) and are mounted on the containing wall (18); and a plurality of holding teeth (21, 22), which project into the pick-up opening (16) in order to prevent the blanks (1) from getting out, are mounted on the containing wall (18) and, are connected to the support brackets (20).

17. A method to carry out a format change in the feeding unit (13) according to claim 1 in order to adjust the feeding unit (13) from the first format of the blanks (1) to the second format of the blanks (1); the method comprises the step of changing the configuration of the feeding unit (13) keeping, at the end of the format change, the reference element in the same position relative to the frame (14).

18. A packer machine comprising:

the feeding unit (13) according to claim 1; and a packing unit, which receives single blanks (1) from the feeding unit (13) and folds the blanks (1).

19. An equipment for the feeding unit (13) according to claim 1 and comprising a plurality of different and interchangeable hoppers (15), each associated with a corresponding format of the blanks (1).

20. A unit (13) to feed blanks (1) in a packer machine and comprising:

a frame (14);

a hopper (15), which is supported by the frame (14), is designed to hold a stack of blanks (1) and has a pick-up opening (16), through which one blank (1) at a time can be picked up from the stack of blanks (1); and a conveyor (17), which is supported by the frame (14) and moves the blanks (1) along a moving path (P), which ends in the hopper (15);

wherein, in order to contain blanks (1) with different formats, the feeding unit (13) can be adjusted by means of a format change operation, which entails changing the feeding unit (13) from a first configuration, which is suited to contain a first format of the blanks (1), to a second configuration, which is suited to contain a second format of the blanks (1), which is different from the first format;

wherein the hopper (15) comprises a first reference element (23), which, in use, is placed in contact with the stack of blanks (1), establishes a position reference for the blanks (1) of the stack of blanks (1), is, relative to the frame (14), in the same position regardless of the format of the blanks (1) and, hence, is not moved, relative to the frame (14), due to a format change operation;

wherein the conveyor (17) comprises at least one conveyor belt (35), which is mounted on the frame (14) and is arranged under the blanks (1) so as to support the blanks (1);

wherein the conveyor belt (35) is mounted on the frame (14) in a movable manner so as to move, during a format change operation, along at least one adjustment direction (D1), which is perpendicular to the moving path (P) along two adjustment directions (D1, D2), which are perpendicular to one another and perpendicular to the moving path (P);

wherein the conveyor (17) comprises: at least one carriage carrying the conveyor belt (35); and a sliding guide, which is parallel to the adjustment direction (D1) and along which the carriage slides in order to move the conveyor belt (35) along the adjustment direction (D1).

21. A unit (13) to feed blanks (1) in a packer machine and comprising:

a frame (14);

a hopper (15), which is supported by the frame (14), is designed to hold a stack of blanks (1) and has a pick-up opening (16), through which one blank (1) at a time can be picked up from the stack of blanks (1); and a conveyor (17), which is supported by the frame (14) and moves the blanks (1) along a moving path (P), which ends in the hopper (15);

wherein, in order to contain blanks (1) with different formats, the feeding unit (13) can be adjusted by means of a format change operation, which entails changing the feeding unit (13) from a first configuration, which is suited to contain a first format of the blanks (1), to a second configuration, which is suited to contain a second format of the blanks (1), which is different from the first format;

wherein the hopper (15) comprises a first reference element (23), which, in use, is placed in contact with the stack of blanks (1), establishes a position reference for the blanks (1) of the stack of blanks (1), is, relative to the frame (14), in the same position regardless of the format of the blanks (1) and, hence, is not moved, relative to the frame (14), due to a format change operation;

wherein a plurality of different and interchangeable hoppers (15) is provided, each associated with a corresponding format of the blanks (1);

wherein each hopper (15) is fixed to the frame (14) in a removable manner in order to be replaced during a format change operation so that the format change operation entails replacing a first hopper (15) associated with the first format with a second hopper (15) associated with the second format.

22. The feeding unit (13) according to claim 21, wherein the frame (14) comprises a support body (25), which is provided with a seat designed to house the hopper (15).

23. The feeding unit (13) according to claim 22, wherein the support body (25) is movable on the frame (14) so as to move, during a format change operation, between a work position, in which the hopper (15) housed in the support body (25) is coupled to and aligned with the conveyor (17), and a replacement position, in which the hopper (15) housed in the support body (25) is uncoupled from and not aligned with the conveyor (17).

24. The feeding unit (13) according to claim 23, wherein the frame (14) comprises:

at least one carriage (26) carrying the support body (25); and a horizontally oriented-sliding guide (27), along which the carriage (26) slides in order to move the support body (25) between the work position and the replacement position.

25. The feeding unit (13) according to claim 23 and comprising a locking device (28), which can be activated in order to lock the support body (25) to the frame (14) when the support body (25) is in the work position.

26. The feeding unit (13) according to claim 22, wherein:

the support body (25) has two upper seats (29) and two lower seats (30);

each hopper (15) comprises two pins (31), which are configured to be inserted into the corresponding lower seats (30); and each hopper (15) comprises two hooking mechanisms (32), which are configured to be inserted into the corresponding upper seats (29) and can be operated so as to lock the hopper (15) to the support body (25).

* * * * *